US006663209B2

(12) United States Patent
Yoshida

(10) Patent No.: US 6,663,209 B2
(45) Date of Patent: Dec. 16, 2003

(54) PRINTING APPARATUS AND METHOD OF CONTROLLING POWER SUPPLY THEREOF

(75) Inventor: Takashi Yoshida, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/781,393

(22) Filed: Feb. 13, 2001

(65) Prior Publication Data

US 2001/0022597 A1 Sep. 20, 2001

(30) Foreign Application Priority Data

Feb. 15, 2000 (JP) ..... 2000-036973

(51) Int. Cl.[7] ..... B41J 29/38
(52) U.S. Cl. ..... 347/14; 347/9
(58) Field of Search ..... 347/14, 15, 43, 347/10, 37, 9

(56) References Cited

U.S. PATENT DOCUMENTS

| | | | |
|---|---|---|---|
| 4,313,124 | A | 1/1982 | Hara |
| 4,345,262 | A | 8/1982 | Shirato et al. |
| 4,459,600 | A | 7/1984 | Sato et al. |
| 4,463,359 | A | 7/1984 | Ayata et al. |
| 4,558,333 | A | 12/1985 | Sugitani et al. |
| 4,608,577 | A | 8/1986 | Hori |
| 4,723,129 | A | 2/1988 | Endo et al. |
| 4,740,796 | A | 4/1988 | Endo et al. |
| 5,053,790 | A | 10/1991 | Stephenson et al. |
| 5,517,229 | A | 5/1996 | Gunther |
| 6,062,678 | A * | 5/2000 | Ishinaga et al. ..... 347/62 |

FOREIGN PATENT DOCUMENTS

| | | |
|---|---|---|
| EP | 0 318 328 | 5/1989 |
| EP | 0 642 925 | 3/1995 |
| JP | 54-56847 | 5/1979 |
| JP | 59-123670 | 7/1984 |
| JP | 59-138461 | 8/1984 |
| JP | 60-71260 | 4/1985 |
| JP | 5-116342 | 5/1993 |
| JP | 9-150530 | 6/1997 |
| JP | 2000-033697 | 2/2000 |
| WO | WO 96/32271 | 10/1996 |

* cited by examiner

*Primary Examiner*—Lamson Nguyen
(74) *Attorney, Agent, or Firm*—Fitzpatrick, Cella, Harper & Scinto

(57) ABSTRACT

Disclosed is a printing apparatus that is capable of stable printing even when the number of printing elements driven simultaneously varies. The printing apparatus includes an input data processor for expanding compressed print data, which has been transmitted from a host device, and outputting a print code sequence; a heat-data generator for generating and outputting heat data, which corresponds to each heater, every heat cycle based upon the print code sequence, and simultaneously counting the number of dots of ink discharged at the same time and outputting a power supply selection signal; a multiple power supply circuit for outputting three different voltages; and a power supply selector which, in accordance with the selection signal [SL (1:0)], selects heater driving power from among the three different voltages and outputs the selected power to a printhead.

18 Claims, 8 Drawing Sheets

FIG. 2

| SL [ 1 : 0 ] | | P1 | P2 | P3 |
|---|---|---|---|---|
| 0 | 0 | OFF | OFF | OFF |
| 0 | 1 | 9vON | OFF | OFF |
| 1 | 0 | OFF | 10vON | OFF |
| 1 | 1 | OFF | OFF | 11vON |

PRINTING APPARATUS AND METHOD OF CONTROLLING POWER SUPPLY THEREOF

FIELD OF THE INVENTION

This invention relates to a printing apparatus and to a method of controlling the power supply thereof. More particularly, the invention relates to a printing apparatus for performing printing on a printing medium by a printhead having a plurality of printing elements, and to a method of controlling the power supply of this recording apparatus.

BACKGROUND OF THE INVENTION

Printers for printing desired information such as characters and images on a sheet-like print medium such as paper or film are available as the information output devices of word processors, personal computers and facsimile machines, by way of example.

Various techniques are known for application to printing methods employed by printers. Ink-jet technology has become the focus of attention in recent years because of its ability to print on a print medium such as paper without contacting the medium, the facility with which it lends itself to color printing and the quiet with which a serial printing method is employed most widely as the ink-jet printing method because of the advantages of lower cost and smaller size. The serial printing method employs a mounted printhead for discharging ink in accordance with desired print information. Printing is carried out while the printhead is scanned back and forth at right angles to the direction in which the print medium such as paper is fed.

The widespread use of personal computers and digital cameras has become pronounced in recent years. In addition, in response to user demand, applications that make it possible to print photographs also have come into greater use with the proliferation of digital cameras and the like.

Improvements in the processing capability and processing capacity of image input devices such as digital cameras have been accompanied by the desire for better image quality and higher definition also in printers used as image output devices. In response to such need, many high-quality printers capable of producing a high-definition output equivalent to that obtained with photographic paper have been proposed.

Though ink-jet printers having the features mentioned above are being used widely as printers that provide an output of high image quality at low running cost. More recently, there has been a greater tendency toward raising the density and number of nozzles that serve as the printing elements in order to obtain a print output of higher definition while printing speed is maintained.

An ink-jet printer is usually provided with discharge-pressure generating sources such as heaters or piezoelectric elements in one-to-one correspondence with the discharge nozzles. If nozzle density is raised and the number of nozzles increased. Therefore, there is an increase in the load on the driving power supply that supplies power to the discharge-pressure generating sources such as heaters or piezoelectric elements.

If the load on the driving power supply increases, a problem which arises is a fluctuation in ink discharge performance caused by a drop in driving voltage. In particular, if a difference develops in ink discharge quantity and ink impact position precision in a case where there is a change in the number of nozzles driven simultaneously by print data, as when only one dot is printed and when a plurality of dots are printed simultaneously, this is reflected directly in the printed result as disturbance of the output image. This problem is not limited to ink-jet printers and arises also in other types of printers that have large numbers of printing elements.

A variation in driving voltage due to the number of nozzles driven simultaneously is influenced not only by the capacity of the power supply but also by the resistance of the wiring from the power supply to the discharge-pressure generating sources and by the common impedance. Accordingly, there has been proposed a printing apparatus in which the printhead and power-supply unit are provided on a carriage, which is scanned back and forth in the main-scan direction, for the purpose of suppressing a change in driving voltage by placing the power supply in close proximity to the discharge-pressure generating sources to shorten the wiring. With such an arrangement, however, the carriage is accelerated and decelerated repeatedly whenever it is scanned, as a result of which the load upon such components as the carriage driving motor increases. This raises the cost of the overall apparatus. Further, since the weight of the carriage per se is increased, problems such as vibration during printing arise.

One conceivable method of avoiding these problems is to refrain from providing the power-supply unit on the carriage and increase greatly the thickness of the wiring in order to lower wiring resistance. However, the larger the number of nozzles, the larger the surface area needed for routing of wiring on the circuit board, the larger the thickness required for the cables and the larger the size required for the connectors. This makes it difficult to lower the cost and reduce the size of the overall apparatus.

SUMMARY OF THE INVENTION

Accordingly, an object of the present invention is to provide a printing apparatus, as well as a method of controlling the power supply thereof, adapted so as to perform printing stably, even when the number of printing elements driven simultaneously changes, without enlarging the power supply and without reducing wiring resistance.

According to the present invention, the foregoing object is attained by providing a printing apparatus for performing printing on a print medium by a printhead having a plurality of printing elements, the apparatus comprising: a plurality of driving voltage sources of voltages that differ from one another; counting means for counting the number of printing elements that are to be driven simultaneously; and power supply selection means for selecting a driving voltage source to be connected to the printhead from among the plurality of driving voltage sources in accordance with the value of the count obtained from the counting means.

Further, according to the present invention, the foregoing object is attained by providing a method of controlling a power supply of a printing apparatus having a plurality of driving voltage sources of voltages that differ from one another, wherein the printing apparatus performs printing on a print medium by a printhead having a plurality of printing elements, the method comprising: a counting step of counting the number of printing elements that are to be driven simultaneously; and power supply selection step of selecting a driving voltage source to be connected to the printhead from among the plurality of driving voltage sources in accordance with the value of the count obtained at the counting step.

Thus, according to the present invention, the driving voltage source supplied to the printhead is selected in accordance with the number of printing elements to be driven at the same time, the selection being from among a plurality of driving voltage sources of different voltages.

This arrangement is such that if the number of printing elements driven simultaneously is large, for example, a driving voltage source for delivering a high voltage is connected to the printhead, thereby making it possible to drive each of the printing elements in a stable manner. A stable printing result is obtained, even when the number of printing elements driven simultaneously changes, without enlarging the power supply or reducing wiring resistance.

It is preferred that the plurality of driving voltage sources are branched from the same stabilized power supply circuit.

It should be noted that if the driving voltage sources, counting means and power supply selection means are provided on a carriage in a serial-scanning-type printing apparatus equipped with the carriage for holding a printhead and scanning the printhead in a direction that intersects the direction in which a print medium is transported, a fluctuation in the driving voltage is suppressed.

Further, it is preferred that the power supply selection means include classifying means for classifying count values into a plurality of categories.

The power supply selection means may be adapted in such a manner that one driving voltage source is connected to the printhead in accordance with the driving capability of each driving voltage source, or in such a manner that a plurality of driving voltage sources are connected to the printhead in accordance with the driving capability of each driving voltage source.

Furthermore, if it is so arranged that the power supply selection means does not connect a driving voltage source to the printhead when the value of the count from the counting means is zero, power consumption can be greatly reduced.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 2 is a table illustrating the correspondence between a power supply selection signal SL and driving power HP output from a power supply selection circuit;

DESCRIPTION OF THE PREFERRED EMBODIMENTS

Preferred embodiments of the present invention will now be described in detail in accordance with the accompanying drawings.

Figure 6:
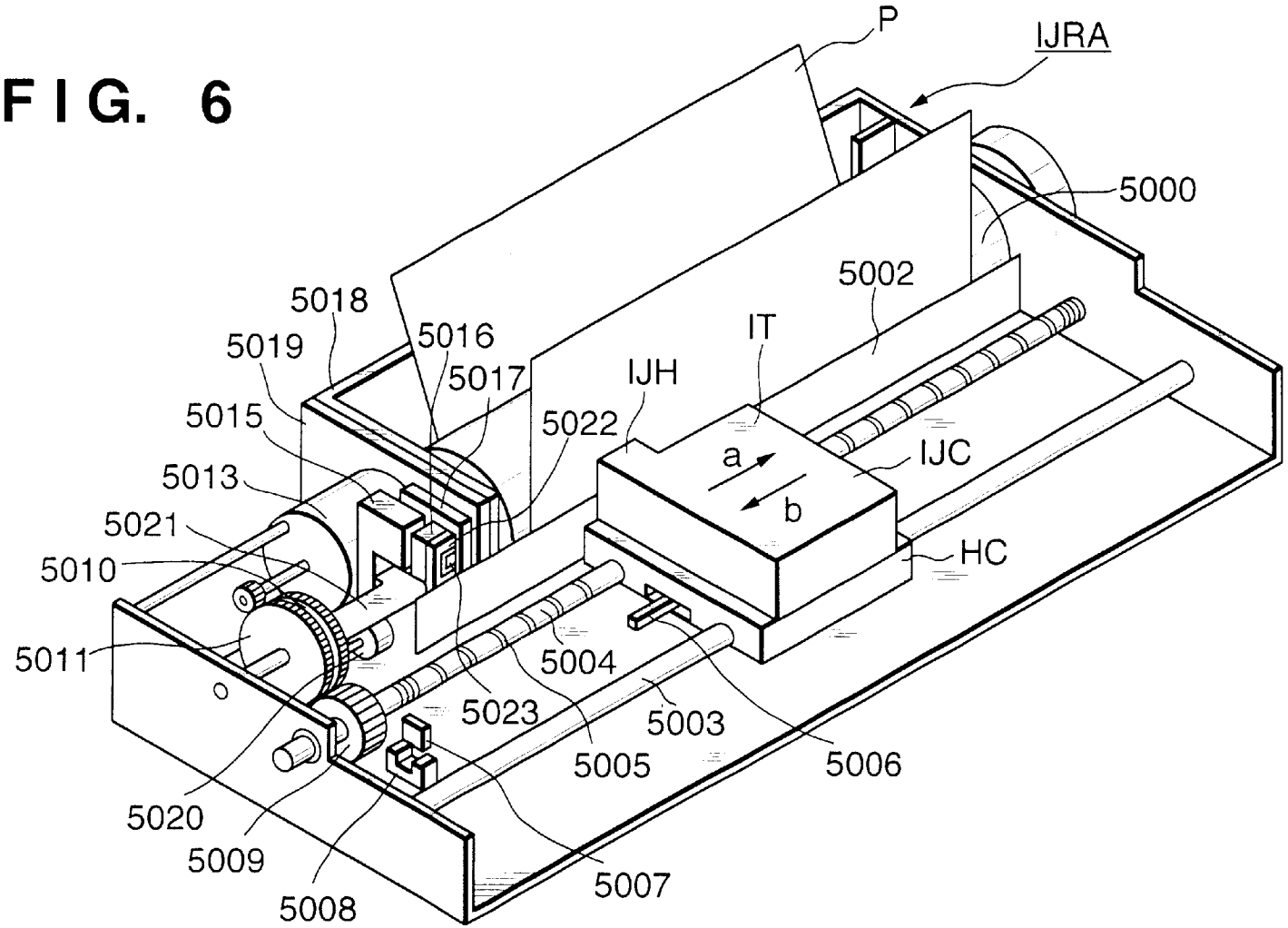
FIG. 6 is an external perspective view showing the general structure of an ink-jet printer, which is a typical embodiment of the present invention.

FIG. 6 is a perspective view showing the outer appearance of an ink-jet printer IJRA as a typical embodiment of the present invention. Referring to FIG. 6, a carriage HC engages with a spiral groove 5004 of a lead screw 5005, which rotates via driving force transmission gears 5009 to 5011 upon forward/reverse rotation of a driving motor 5013. The carriage HC has a pin (not shown), and is reciprocally scanned in the directions of arrows a and b in FIG. 6. An integrated ink-jet cartridge IJC which incorporates a printhead IJH and an ink tank IT is mounted on the carriage HC.

Reference numeral 5002 denotes a sheet pressing plate, which presses a paper sheet against a platen 5000, ranging from one end to the other end of the scanning path of the carriage. Reference numerals 5007 and 5008 denote photocouplers which serve as a home position detector for recognizing the presence of a lever 5006 of the carriage in a corresponding region, and used for switching, e.g., the rotating direction of the motor 5013.

Reference numeral 5016 denotes a member for supporting a cap member 5022, which caps the front surface of the printhead IJH; and 5015, a suction device for sucking ink residue through the interior of the cap member. The suction device 5015 performs suction recovery of the printhead via an opening 5023 of the cap member 5015. Reference numeral 5017 denotes a cleaning blade; 5019, a member which allows the blade to be movable in the back-and-forth direction of the blade. These members are supported on a main unit support plate 5018. The shape of the blade is not limited to this, but a known cleaning blade can be used in this embodiment.

Reference numeral 5021 denotes a lever for initiating a suction operation in the suction recovery operation. The lever 5021 moves upon movement of a cam 5020, which engages with the carriage, and receives a driving force from the driving motor via a known transmission mechanism such as clutch switching.

The capping, cleaning, and suction recovery operations are performed at their corresponding positions upon operation of the lead screw 5005 when the carriage reaches the home-position side region. However, the present invention is not limited to this arrangement as long as desired operations are performed at known timings.

Figure 7:
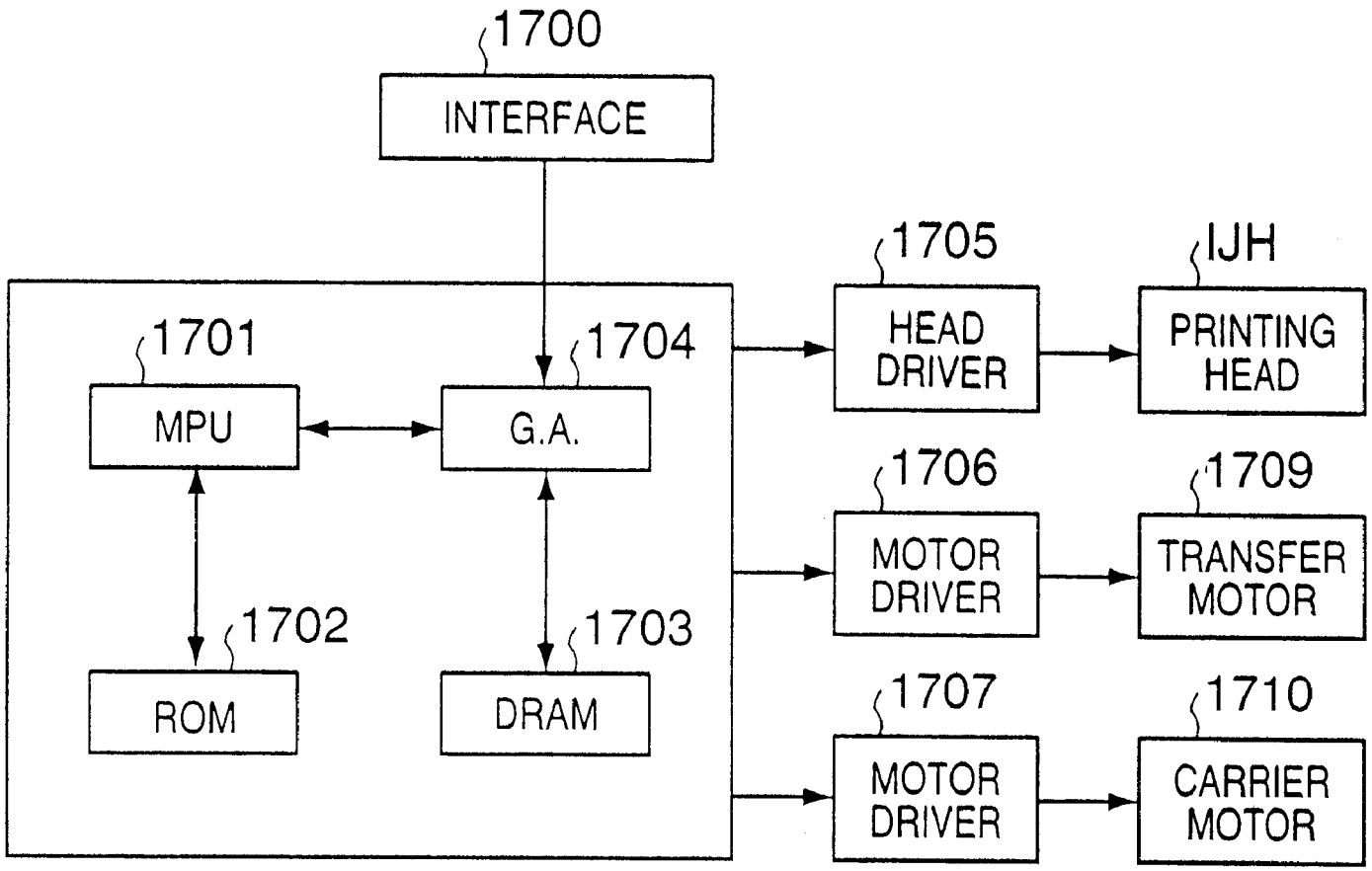
FIG. 7 is a block diagram illustrating the structure of a control circuit for controlling the ink-jet printer.

FIG. 7 is a block diagram showing the arrangement of a control circuit of the ink-jet printer. Referring to FIG. 7 showing the control circuit, reference numeral 1700 denotes an interface for inputting a printing signal from an external unit such as a host computer; 1701, an MPU; 1702, a ROM for storing a control program (including character fonts if necessary) executed by the MPU 1701; and 1703, a DRAM for storing various data (the printing signal, printing data supplied to the printhead, and the like). Reference numeral 1704 denotes a gate array (G.A.) for performing supply control of printing data to the printhead IJH. The gate array 1704 also performs data transfer control interface 1700, the MPU 1701, and the RAM 1703. Reference numeral 1710 denotes a carrier motor for transferring the printhead IJH in the main scanning direction; and 1709, a transfer motor for transferring a printing sheet. Reference numeral 1705 denotes a head driver for driving a head; and 1706 and 1707, motor drivers for driving the transfer motor 1709 and the carrier motor 1710.

The operation of the above control arrangement will be described below. When a printing signal is input to the interface 1700, the printing signal is converted into printing data for a printing operation between the gate array 1704 and the MPU 1701. The motor drivers 1706 and 1707 are driven, and the printhead is driven in accordance with the printing data supplied to the head driver 1705, thus performing the printing operation.

Though the control program executed by the MPU 1701 is stored in the ROM 1702, an arrangement can be adopted in which a writable storage medium such as an EEPROM is additionally provided so that the control program can be altered from a host computer connected to the ink-jet printer IJRA.

Note that the ink tank IT and the printhead IJH are integrally formed to construct an exchangeable ink cartridge IJC, however, the ink tank IT and the printhead IJH may be separately formed such that when ink is exhausted, only the ink tank IT can be exchanged for new ink tank.

Figure 8:
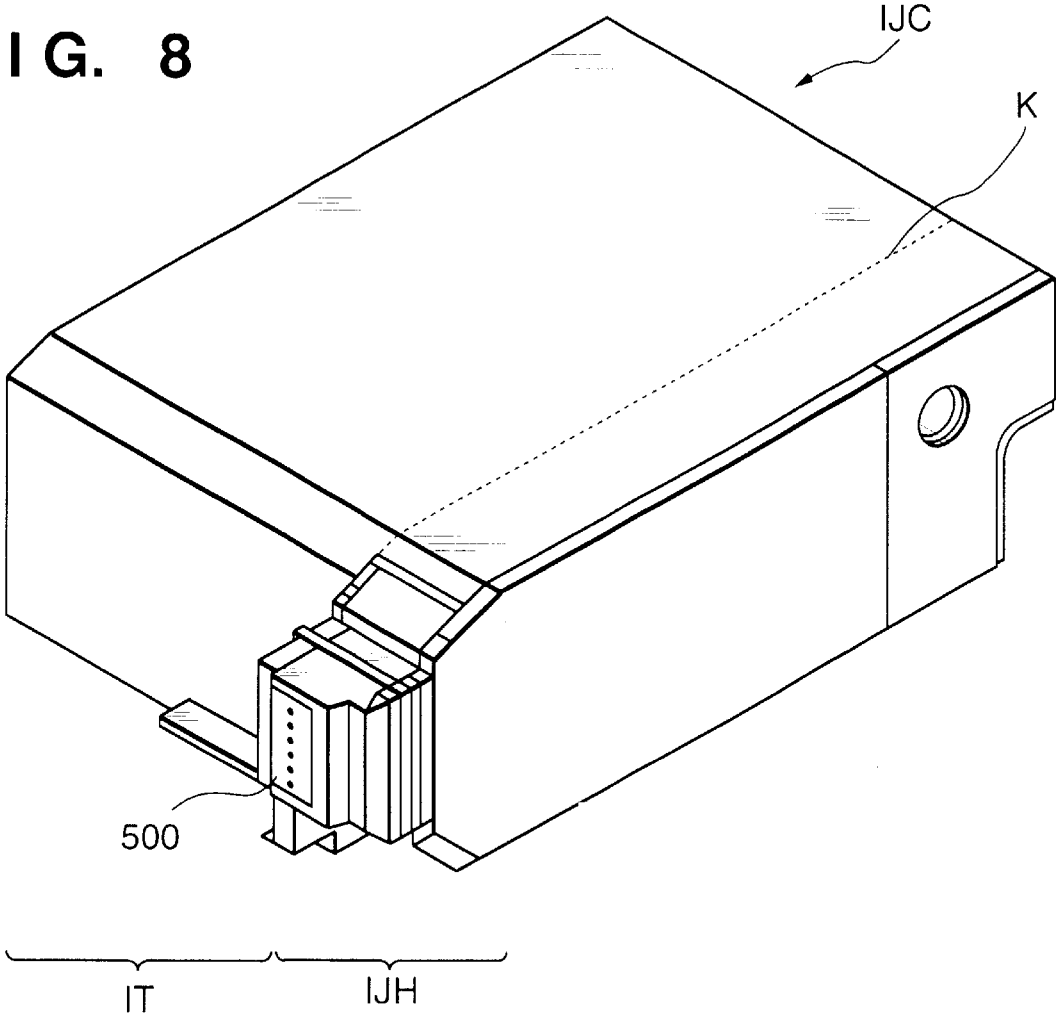
FIG. 8 is an external perspective view illustrating the structure of an ink cartridge.

FIG. 8 is a perspective view showing the structure of the ink cartridge IJC where the ink tank and the head can be separated. As shown in FIG. 8 in the ink cartridge ITC, the ink tank IT and the printhead IJH can be separated along a line K. The ink cartridge IJC has an electrode (not shown) for receiving an electric signal supplied from the carriage HC side when it is mounted on the carriage HC. By the electric signal, the printhead IJH is driven as above, Note that in FIG. 8, numeral 500 denotes an ink-discharge orifice array. Further, the ink tank IT has a fiber or porous ink absorbing body. The ink is held by the ink absorbing body.

Control of a driving power supply in an ink-jet printer according to embodiments of the present invention will now be described.

First Embodiment

Figure 1:
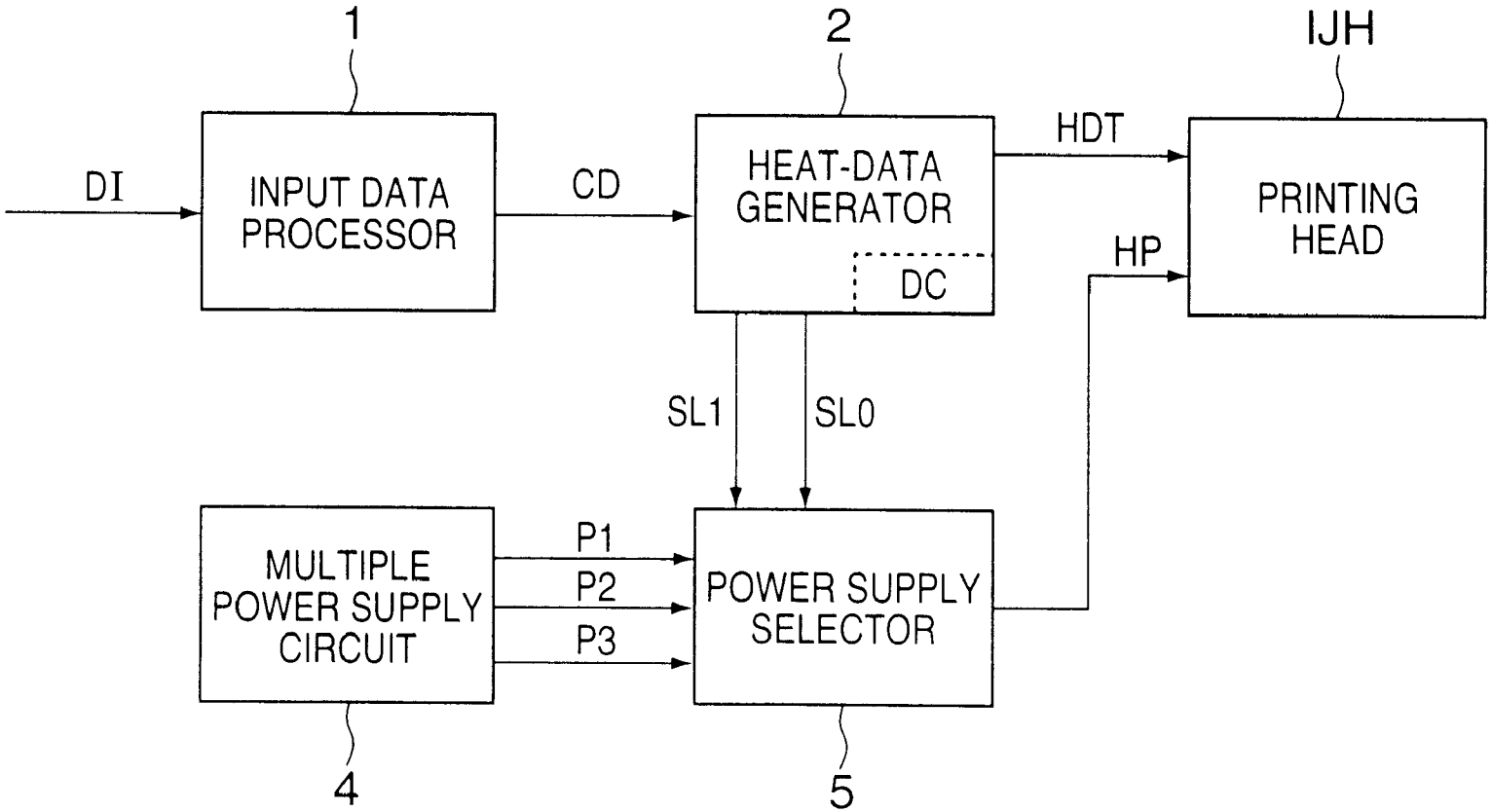
FIG. 1 is a block diagram illustrating the structure of a first embodiment of a power supply controller.

FIG. 1 is a functional block diagram illustrating a first embodiment of components for controlling a driving power supply mounted in an ink-jet printer according to the present invention. As shown in FIG. 1, an input data processor 1 expands compressed print data DI, which has been transmitted from a host device (not shown), and outputs a print code sequence CD. A heat-data generator 2, which has a dot counter DC, generates and outputs heat data HDT, which corresponds to each heater, every heat cycle based upon the print code sequence CD, and simultaneously counts the number of dots discharged at the same time and output a power supply selection signal SL (1:0).

An ink-jet printhead IJH has a plurality of nozzle groups each of which consists of 96 nozzles, and a plurality of groups of heater rows corresponding to the nozzle groups, and performs heating/discharge one group at a time in accordance with the heat data HDT that enters every heat cycle. Heater driving power HP is input to the printhead IJH. A multiple power supply circuit 4 possesses three output voltage stages for outputting three different voltages, namely P1 (9V), P2 (10V) and P3 (11V). The input to the multiple power supply circuit 4 may be a commercial AC power source or a DC power source such as a battery. A power supply selector 5 selects and outputs the heater driving power HP for the printhead from these three voltages in accordance with the selection signal SL [1:0].

FIG. 2 illustrates correspondence between combinations of the power supply selection signals SL output from the heat-data generator 2 and the heater driving power HP output from the power supply selector 5 in accordance with the power supply selection signals SL. As shown in FIG. 2, the multiple power supply circuit 4 delivers four different outputs, namely zero, 9V (P1), 10V (P2) and 11V (P3) depending upon corresponding ones of the four combinations of the power supply selection signal SL.

Figure 4:
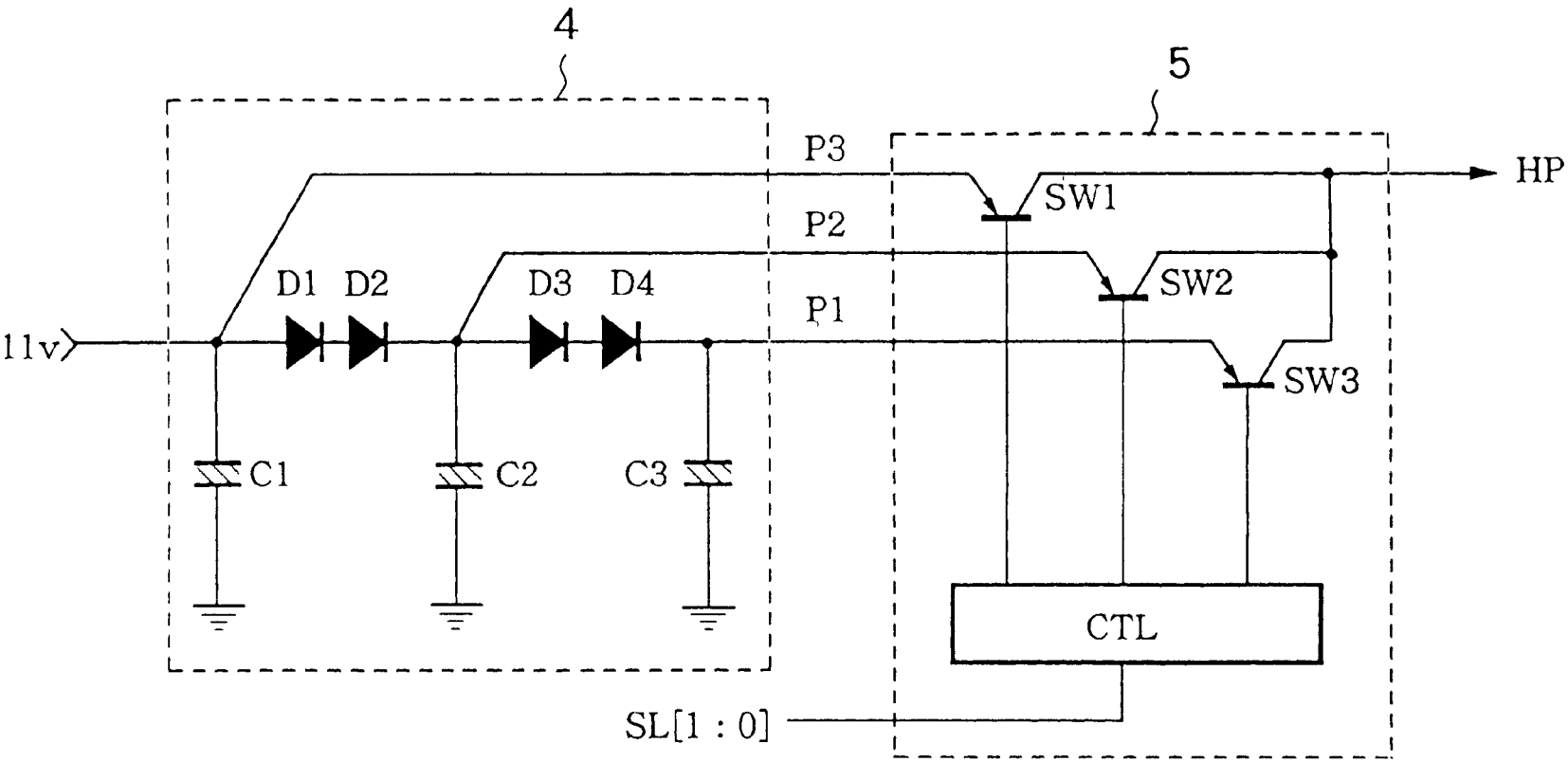
FIG. 4 is a circuit diagram illustrating an example of the structure of part of a multiple power supply circuit and power supply selection circuit shown in FIG. 1.

FIG. 4 is a diagram showing an example of the structure of part of the multiple power supply circuit 4 and the structure of the power supply selector 5. In order to simplify the circuitry, FIG. 4 shows an arrangement for obtaining voltage outputs of multiple types using the forward voltages of diodes.

The circuitry corresponding to the multiple power supply circuit 4 receives direct current of 11V, which has been stabilized by an ordinary method, as the input thereto and generates three different voltages, namely P3 obtained by outputting the input directly, P2 obtained by dropping the input voltage using two diodes D1 and D2, and P1 obtained by dropping the input voltage further using two diodes D3 and D4. Three capacitors C1, C2 and C3 are provided for corresponding ones of the three voltages.

The circuitry corresponding to the power supply selector 5 is provided with power transistors SW1 to SW3 for outputting the voltages P3 to P1, respectively, and a controller CTRL for obtaining the output voltage HP by turning on the transistors SW1 to SW3 selectively in accordance with the SL (1:0) input.

Figure 3:
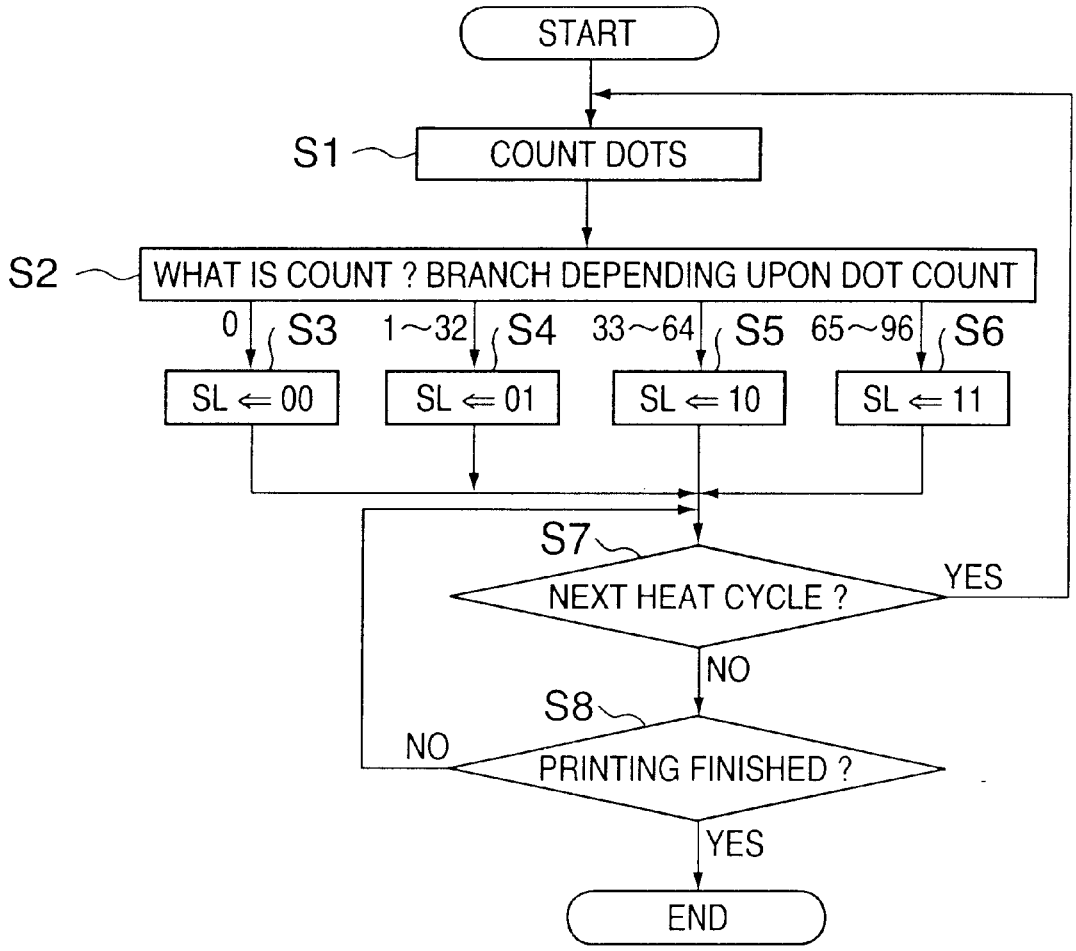
FIG. 3 is a flowchart illustrating processing executed by a heat-data generator shown in FIG. 1.

Next, the processing executed by the heat-data generator 2 of this embodiment will be described in accordance with the flowchart of FIG. 3.

First, the heat data of the present heat cycle is expanded and the number of dots to be discharged are counted (step S1). Control branches at step S2 for the purpose of deciding an output in accordance with the number of dots counted. More specifically, if the number of dots is zero, "00" is output as SL to turn the power supply output OFF (step S3). If the number of dots is 1 to 32, "01" is output as SL to adopt 9V as HP (step S4). If the number of dots is 33 to 64, "10" is output as SL to adopt 10V as HP (step S5). If the number of dots is 65 to 96, "11" is output as SL to adopt 11V as HP (step S6).

If output of power supply selection signal SL has ended, it is determined whether the next heat cycle has arrived (step S7). If the next heat cycle has arrived ("YES" at step S7), then control returns to step S1 and processing is repeated from this step onward. If the heat data is not the next cycle of heat data ("NO" at step S7) and it is determined at step S8 that printing has ended, then processing is exited.

In accordance with this embodiment, as set forth above, the appropriate heater power supplies (i.e., a combination thereof) are selected in dependence upon the number of heaters energized simultaneously, thereby making it possible to realize an ink-jet printer having a stable discharge characteristic despite a large number of nozzles.

Second Embodiment

Figure 5:
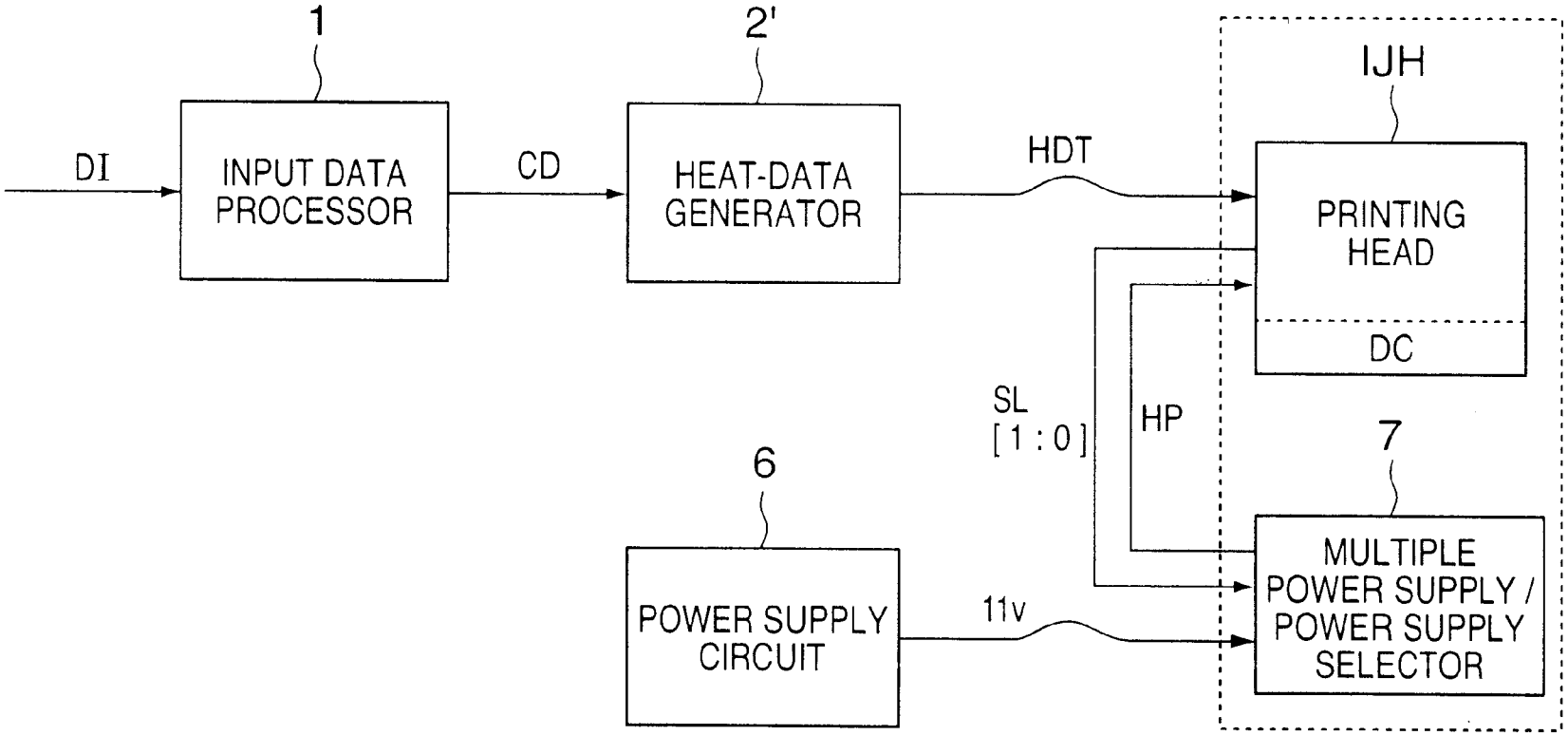
FIG. 5 is a block diagram illustrating the structure of a second embodiment of a power supply controller.

FIG. 5 is a functional block diagram illustrating a second embodiment of a power supply controller mounted in an ink-jet printer according to the present invention. Here a multiple power supply/power supply selector 7, which corresponds to the portion shown in FIG. 4 described in the first embodiment, is disposed on a carriage together with the printhead IJH.

According to this embodiment, the counting of the number of dots is performed by a counter within the printhead IJH based upon data sent from a heat-data generator 2'. A power supply circuit 6 per se, which object such as a transformer for supplying stabilized power of 11V, is not mounted on the carriage. As a result, the carriage is not subjected to a very heavy load and the distance between the power outlet and the heaters is reduced to lower the wiring resistance without increasing the size and 5 raising the cost of the apparatus.

In the first and second embodiments, a case in which only one of the transistors SW1 to SW3 is turned ON in accordance with the signal SL is described. However, an arrangement may be adopted in which a plurality of the transistors SW are turned on simultaneously for applications in which a larger power-supply capacity is required.

In the above embodiments, droplets discharged from the printhead are ink droplets, and a liquid stored in the ink tank is ink. However, the liquid to be stored in the ink tank is not limited to ink. For example, a treatment solution to be discharged onto a printing medium so as to improve the fixing property or water resistance of a printed image or its image quality may be stored in the ink tank.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, not only an exchangeable chip type printhead, as described in the above embodiment, which can be electrically connected to the apparatus main unit and can receive an ink from the apparatus main unit upon being mounted on the apparatus main unit but also a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

The present invention can be applied to a system constituted by a plurality of devices (e.g., host computer, interface, reader, printer) or to an apparatus comprising a single device (e.g., copying machine, facsimile machine).

Further, the object of the present invention can also be achieved by providing a storage medium storing program codes for performing the aforesaid processes to a computer system or apparatus (e.g., a personal computer), reading the program codes, by a CPU or MPU of the computer system or apparatus, from the storage medium, then executing the program.

In this case, the program codes read from the storage medium realize the functions according to the embodiments, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides aforesaid functions according to the above embodiments are realized by executing the program codes which are read by a computer, the present invention includes a case where an OS (operating system) or the like working on the computer performs a part or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or entire process in accordance with designations of the program codes and realizes functions of the above embodiments.

If the present invention is realized as a storage medium, program codes corresponding to the above mentioned flowchart (FIG. 3) are to be stored in the storage medium.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus for performing printing on a print medium by scanning a carriage for mounting a printhead having a plurality of printing elements, comprising:

voltage generating means for generating a plurality of voltages that differ from one another from a predetermined voltage supplied from a stabilized power supply circuit provided outside of the carriage;

counting means for counting data regarding a number of printing elements that are to be driven simultaneously in order to perform the printing on the print medium; and power supply selection means for selecting a driving voltage to be applied to the printhead from the plurality of voltages in accordance with the counted value obtained from said counting means, wherein said voltage generating means and said power supply selection means are mounted on the carriage.

2. The apparatus according to claim 1, wherein said voltage generating means generates the plurality of voltages by branching the predetermined voltage supplied from said stabilized power supply circuit.

3. The apparatus according to claim 1, wherein said power supply selection means includes classifying means for classifying count values from said counting means into a plurality of categories.

4. The apparatus according to claim 1, wherein said power supply selection means connects one voltage to said printhead.

5. The apparatus according to claim 1, wherein said power supply selection means connects a plurality of voltages to said printhead.

6. The apparatus according to claim 1, wherein said power supply selection means connects no voltage to said printhead when a count value from said counting means is zero.

7. The apparatus according to claim 1, wherein said printhead is an ink-jet printhead which performs the printing by discharging ink.

8. The apparatus according to claim 7, wherein said printhead discharges ink by utilizing thermal energy, said printhead having a thermal energy transducer for generating the thermal energy applied to the ink.

9. The apparatus according to claim 1, wherein said power supply selection means selects a combination of the voltages from the plurality of voltages.

10. A method of controlling a power supply of a printing apparatus, wherein the printing apparatus performs printing on a print medium by scanning a carriage for mounting voltage generating means, power supply selection means and a printhead having a plurality of printing elements, said method comprising:

a generating step of generating a plurality of driving voltages that differ from one another from a predetermined voltage supplied from a stabilized power supply circuit provided outside of the carriage, by the voltage generating means;

a counting step of counting data regarding a number of printing elements that are to be driven simultaneously in order to perform the printing on the print medium; and a power supply selection step of selecting a driving voltage to be applied to the printhead from the plurality of voltages in accordance with the counted value obtained at said counting step by the power supply selection means.

11. The method according to claim 10, wherein said generating step includes a branching step of branching the plurality of voltages from the predetermined voltage supplied from the stabilized power supply circuit.

12. The method according to claim 10, wherein said power supply selection step includes a classifying step of classifying count values from said counting step into a plurality of categories.

13. The method according to claim 10, wherein one voltage is connected to said printhead at said power supply selection step.

14. The method according to claim 10, wherein a plurality of voltages are connected to said printhead at said power supply selection step.

15. The method according to claim 10, wherein no voltage is connected to said printhead at said power supply selection step when a count value from said counting step is zero.

16. The method according to claim 10, wherein said power supply selection step selects a combination of the voltages from the plurality of voltages.

17. A storage medium storing code of a program for implementing a method of controlling a power supply of a printing apparatus, wherein the printing apparatus performs printing on a print medium by scanning a carriage for mounting voltage generating means, power supply selection means and a printhead having a plurality of printing elements, said program comprising:

a generating step of generating a plurality of driving voltages that differ from one another from a predetermined voltage supplied from a stabilized power supply circuit provided outside of the carriage, by the voltage generating means;

a counting step of counting data regarding a number of printing elements that are to be driven simultaneously in order to perform the printing on the print medium; and a power supply selection step of selecting a driving voltage to be applied to the printhead from the plurality of voltages in accordance with the counted value obtained at said counting step by the power supply selection means.

18. The storage medium according to claim 17, wherein said power supply selection step selects a combination of the voltages from the plurality of voltages.

* * * * *